US006425227B1

(12) United States Patent
Salm et al.

(10) Patent No.: US 6,425,227 B1
(45) Date of Patent: Jul. 30, 2002

(54) METHOD AND DEVICE IN PARTICULAR FOR PACKAGING FLAT OBJECTS

(75) Inventors: Thomas Salm, Aachen; Hans-Josef Driessen, Eschweiler, both of (DE)

(73) Assignee: Winkler + Duennebier AG, Neuwied (DE)

( * ) Notice: Subject to any disclaimer, the term of this patent is extended or adjusted under 35 U.S.C. 154(b) by 0 days.

(21) Appl. No.: 09/423,592

(22) PCT Filed: May 12, 1998

(86) PCT No.: PCT/DE98/01310

§ 371 (c)(1),
(2), (4) Date: Nov. 12, 1999

(87) PCT Pub. No.: WO98/51570

PCT Pub. Date: Nov. 19, 1998

(30) Foreign Application Priority Data

May 14, 1997 (DE) ..... 297 08 542 U

(51) Int. Cl.[7] ..... B65B 25/14; B65B 35/56

(52) U.S. Cl. ..... 53/446; 53/447; 53/544; 414/791.4

(58) Field of Search ..... 53/446, 447, 475, 53/537, 544, 247; 414/788.3, 790.2, 791.3, 791.4

(56) References Cited

U.S. PATENT DOCUMENTS

| | | | | |
|---|---|---|---|---|
| 3,404,609 A | | 10/1968 | Hartbauer et al. | |
| 3,550,349 A | * | 12/1970 | Kerker | 53/529 |
| 3,596,779 A | | 8/1971 | Osteen | |
| 3,700,127 A | | 10/1972 | Kurk et al. | 53/446 |
| 3,970,202 A | | 7/1976 | Speggiorin et al. | |
| 4,481,751 A | | 11/1984 | Ujhelyi | 53/446 |

FOREIGN PATENT DOCUMENTS

| | | | | |
|---|---|---|---|---|
| DE | 2018592 | | 10/1971 | |
| DE | 29708542 | | 7/1997 | |
| EP | 0506606 B1 | * | 12/1994 | B65B/25/14 |
| FR | 2089756 | | 1/1972 | |
| WO | WO-98/13263 A1 | | 4/1998 | |

* cited by examiner

*Primary Examiner*—Stephen F. Gerrity
(74) *Attorney, Agent, or Firm*—W. F. Fasse; W. G. Fasse

(57) ABSTRACT

The invention relates to a method and apparatus for the handling of individual flat articles coming out of a production machine (3). The articles may be particularly letter envelopes, which are assembled and, if needed further processed and packaged. The core of the invention resides in that initially a plurality of flat articles or letter envelopes (2, 2*a*) are lifted as partial stacks (8, 8*a*) and then are deposited at another location, and in that the partial stacks, during lifting and/or depositing (rearranging), are moved in such a way that the flat articles or letter envelopes (2, 2*a*) are standing, following the deposition, on the same side or edge (b) as originally or on another side or edge (a).

22 Claims, 12 Drawing Sheets

METHOD AND DEVICE IN PARTICULAR FOR PACKAGING FLAT OBJECTS

CROSS REFERENCE TO RELATED APPLICATIONS

This application has been filed under 35 U.S.C. 371 as the national stage filing of International Application serial number PCT/DE98/01310, filed May 12, 1998, and which designated the United States.

FIELD OF THE INVENTION

The invention relates to a method and apparatus for handling and more particularly packaging flat articles such as stationery envelopes.

BACKGROUND INFORMATION

Stationery envelopes of paper, that is to say both letter envelopes and also mailing bags, are as a rule produced of single-piece, multi-folded cutouts. It is a known practice to connect together neighboring edges of the folded cutouts with the aid of folded over adhesive flaps. At the openings for filling, the closing flaps which lie flat, are kept in the unbonded condition. After manufacture in a production machine the stationery envelopes are packed in stacks of for instance 500 or 1000 pieces in cartons. In the area of the closing flaps of each stationery envelope in a stack only two paper plies rest on top of each other, whereas in the area of the adhesively bonded side edges three paper plies are resting on top of each other. Thus, one and the same stationery envelope has in the empty state at different locations differences in thickness which amount to a third of the maximum thickness. A stack with many stationery envelopes is for this reason substantially thicker in the area of the bonded flaps than adjacent to edges which are merely folded. In order to compensate for this different thickness of the letter envelopes it is a known practice to manually pack the envelopes in small stacks, which are offset by 180°, directly in shipping cartons.

Furthermore, the European Patent Publication EP 0 506 606 B1 discloses a method and a device for packaging stationery envelopes in boxes, wherein the stationery envelopes coming from a production machine as an upright endless stack are first divided up into partial stacks and then pushed off the conveyor belt into an auxiliary device while maintaining their position. The auxiliary device holds the partial stack pushed off the conveyor belt until it is accepted by a movable entraining carrier, which deposits the stack in a movably arranged collecting basket, which is at least alternatingly able to be turned about a basket axis which is perpendicular to the stack. In this collecting basket the partial stacks in different positions are then first collected and then jointly removed from it, then pressed together and pushed into a box held ready.

This method and the respective device are expensive and complicated. The device comprises a plurality of different components, which are not only expensive to produce but are also problematical in operation and liable to failure. A particular problem is the ever recurring need for resetting to different stationery envelope formats.

SUMMARY OF THE INVENTION

The invention aims at providing a simple, reliable, low-cost method for a positionally accurate turning over of flat articles and more particularly stationery envelopes. The method shall be easily adaptable to different formats. The invention also aims at providing a suitable device for these purposes with a compact construction for the handling of articles or stationery envelopes coming from a production machine. They can then be further processed or preferably put in stacks and packaged. At least in the case of stationery envelopes the articles will have the same or a different thickness of their material at the same positions.

In order to achieve this object the invention provides, that first a plurality of flat articles or stationery envelopes are lifted up as partial stacks and then deposited at another location and that the partial stacks on raising and/or lowering (rearranging) are so moved that the articles or stationery envelopes after depositing stand on the same side or edge as originally or on another side or edge.

In accordance with the invention the stationery envelopes are no longer first collected in groups of partial stacks in a collecting basket serving as an intermediate storage, with, respectively, different alignments and then directly transferred to a shipping carton. Rather, the articles are placed immediately after the production machine in groups of partial stacks selectively on any desired edge or, respectively, selectively on one of their margins. Stacks of any desired size may be then formed from the partial stacks, for example for packing and after reaching the intended size may for example be transferred to a packing station.

Instead of stationery envelopes it is however also possible for hygienic articles and other flat articles, in the case of which there may be similar problems, to be processed using the intermediate steps in accordance with the invention and then further processed and/or packed in any desired fashion. This possibility-covers cases in which the articles or, respectively, stationery envelopes are not made ready for a boxing device but also for a bundling device, where they may be provided with a band and held together, whereupon they are either packaged as a small partial stack in cellophane or boxed as a larger stack.

For lifting and lowering the partial stacks a turning station is employed in accordance with the invention, which comprises at least one movable carrier, which may be a movable arm. At the free end of this arm or carrier at least one also movable gripper is arranged, which is capable of gripping a partial stack and after the rearrangement releasing it again.

As a further development of the invention it is possible for the gripper to be movable about a gripper axis parallel to a pivot or rotation axis of the carrier and/or about a gripper axis perpendicular thereto, whereby it is possible to satisfy any conceivable requirements.

BRIEF DESCRIPTION OF THE DRAWINGS

The invention will be described in more detail with reference to embodiments, which are shown in the drawing, wherein.

DETAILED DESCRIPTION OF PREFERRED EMBODIMENTS AND OF THE BEST MODE OF THE INVENTION

Figure 1:
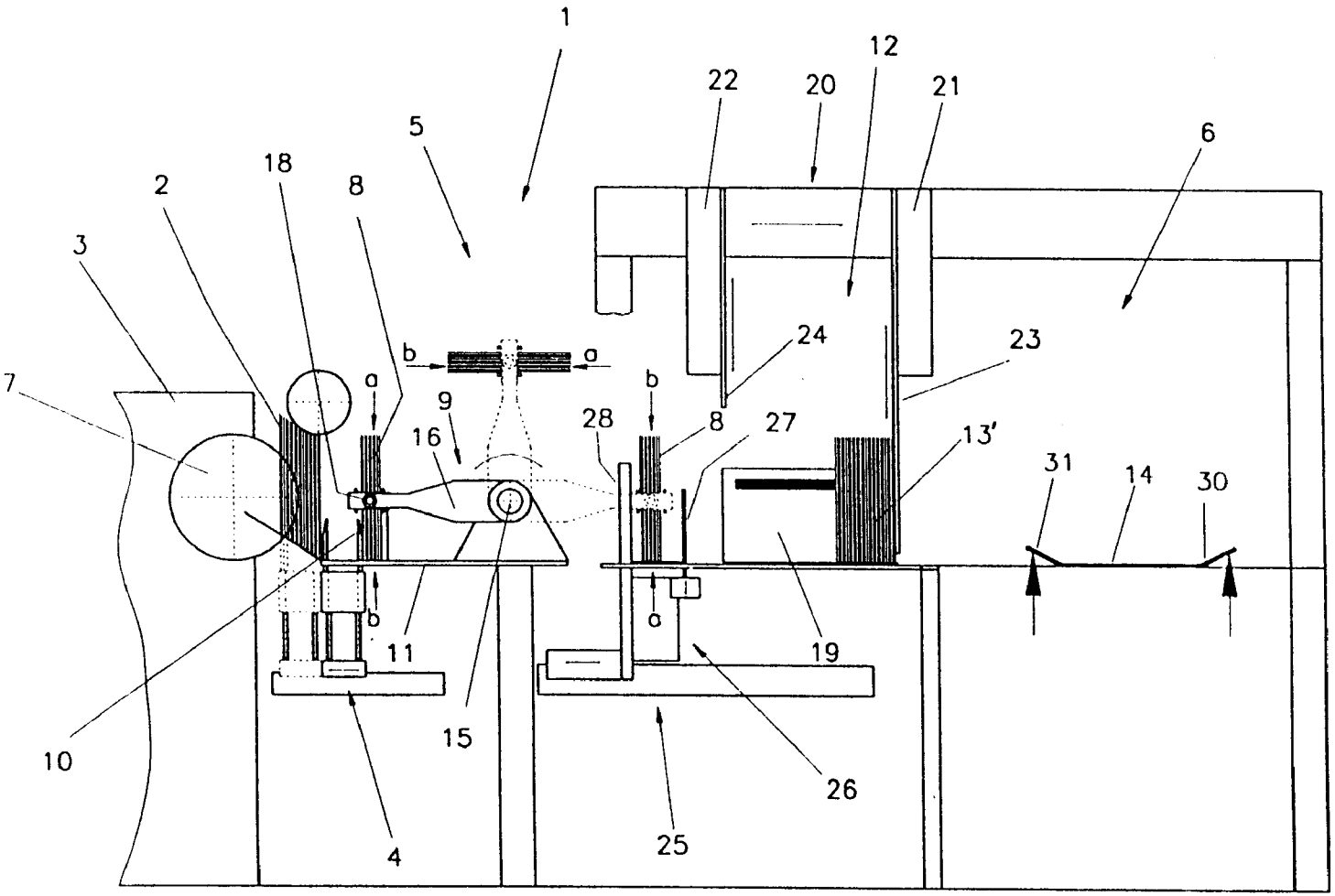
FIG. 1 is a side view of a principle sketch of a device for packaging.

A device 1 for packaging flat articles and, in the actual embodiment for stationery envelopes 2, comprises, following a production machine 3, a transfer and separating station 4, a turning station 5 and a packaging station 6 (FIG. 1).

The stationery envelopes 2 coming separately and continuously at a high speed from the production machine 3 are deposited with the aid of a compartmented wheel 7 in the transfer and separating station 4, held there and finally as a partial stack 8 passed on to a turning device 9 of the turning station 5. For holding the stationery envelopes 2 and for the formation of partial stacks 8 the transfer and separating station 4 possesses horizontally and vertically moving holding and supporting elements 10 in the form of forks, separating blades or the like. These holding and supporting elements 10 are movable in step with the machine by basically known pneumatic and/or hydraulic drives, not illustrated in the drawing, in a horizontal and vertical direction or, respectively, in a direction parallel and/or perpendicular to a stacking plane 11. From this stacking plane 11 the turning device 9 takes one partial stack 8 at a time and places or conveys it into a station 12 (collecting station) associated with the packing station 6, in which collecting station the partial stacks 8, rearranged by the turning device 9, are formed into a stack 13 of a predetermined size.

Figure 2:
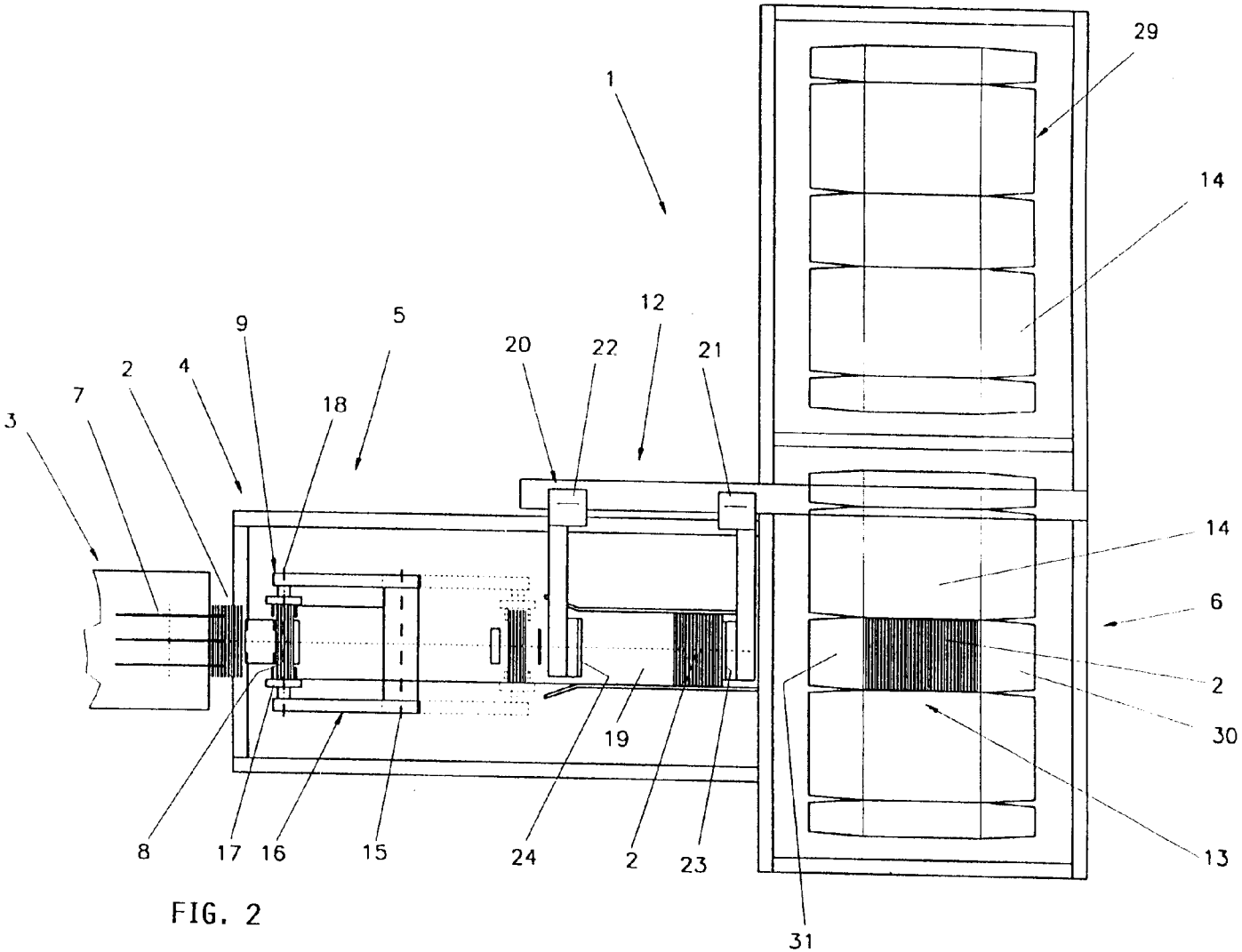
FIG. 2 shows a plan view of the device according to FIG. 1 on a smaller scale.

The turning device 9 comprises, in accordance with the embodiment depicted in FIGS. 1 and 2, a carrier 16 movable about an axis 15, which at its free end bears a gripper 17 for one respective partial stack 8. The gripper 17 is pivotally mounted on the carrier 16 for movement about a gripper axis 18, which extends in parallel to the axis 15 of the carrier 16. The gripper 17 is furthermore provided with its own drive so that it is not only able to take up partial stacks 8 of different size and deposit same again but is also selectively movable about the gripping axis 18 relative to the carrier 16.

The carrier 16 is finally pivotable out of a position, in the working example of FIGS. 1 and 2, facing the compartmented wheel 7 (full lines) through 180° into a position facing the packing station 6 (dashed lines) and is able to again be pivoted back from there. Its axis 15 is consequently a pivot axis. It further comprises two arms arranged spaced from each other and forming a pivoting arm. (FIG. 2).

The compartmented wheel 7 deposits all stationery envelopes 2 in the same manner in the transfer and separating station 4 so that respectively the same edges "a" of the stationery envelopes 2 are at the top and all edges "b" parallel thereto are at the bottom (FIG. 1). If now a partial stack 8 is rearranged by the carrier 16 and its gripper 17 only to the side of the packaging station 6, the edges a of the stationery envelopes 2 will be at the bottom and the edges b of the stationery envelopes will be at the top. If flat articles other than stationery envelopes 2 are rearranged, the same applies for corresponding sides of the articles.

For a stack 13 to be formed in the station 12, of partial stacks 8, whose stationery envelopes 2 have their edges a and b alternatingly at the bottom and at the top, the respective next partial stack 8 will be additionally pivoted by its gripper 17 about the gripper axis 18 through 180° in the direction of rotation of the carrier 16 or opposite thereto and then deposited in this position in the station 12. In this manner it is possible to form a stack 13 with technically simple means, in which the partial stacks are respectively offset relative to each other.

The station 12 (collecting station) serving for the formation of the stack 13 essentially comprises a channel-shaped stacking path 19 with a movable clamping and holding mechanism 20 arranged thereabove. This clamping and holding mechanism 20 includes two holders 21 and 22 movable relative to each other and adjustable in their spacing from each other. A clamping sheet metal 23 or 24 is arranged on the respective holder in a vertically up and down movable manner. In its lowered position the clamping sheet metal 23 forms the rear wall of the channel-shaped stacking path 19, on which the stack 13' being formed is supported.

For the transfer of the partial stacks 8 from the turning device 9 a receiving device 25 is provided, having a gripper carriage 26, which has a backing element 27 which is fixed in the horizontal direction but can be lowered in the vertical direction. Associated with the backing element 27 there is a horizontally movable clamping element 28 mounted on the gripper slide 26. With the aid thereof it is possible for a deposited partial stack 8 to be pressed against the backing element 27 and after release by the gripper 17, same may be moved against the stationery envelopes 2 of the stack 13 to be formed and pressed on.

As soon as a partial stack 8 is pressed against the stack 13' to be formed, the backing element 27, which may be very thin, is lowered so that the gripper carriage 26 can be moved back into its starting position (on the left in FIG. 1). The stack 13' to be formed in this case is held between the side walls of the channel-shaped stacking path 19 with the aid of profiled elements or the like.

Adjoining the stacking path 19 there is the actual packaging station 6, wherein the stack 13 is packaged in a carton cutout 14. A stored stack 29 of carton cutouts 14 is located offset to the side next to the packaging station 6 (FIG. 2).

As soon as the stack 13' in the stacking path 19 has reached the desired size, the clamping sheet metal 24 on the holder 22 is lowered and the holder 22 is moved toward the holder 21 so that the stack 13 is compressed between the two clamping sheet metals 23 and 24. In this position the stack 13 is pushed onto the carton cutout 14 (FIG. 2) in the packaging station 6. Now the side flaps 30 and 31 of the carton cutout 14 are erected in a basically known manner, as also appears from FIG. 1. Simultaneously the stack 13 is held between the now vertical side flaps 30 and 31. As soon as this packaging step is completed the two clamping sheet metals 23 and 24 are raised again so that the clamping and holding mechanism 20 can be moved back into its starting position above the channel-shaped stacking path 19. Simultaneously the clamping sheet metal 23 is lowered till the stack 13 is encased with the carton cutout 14 in the packaging station 6 until a complete package has been produced.

Figure 3:
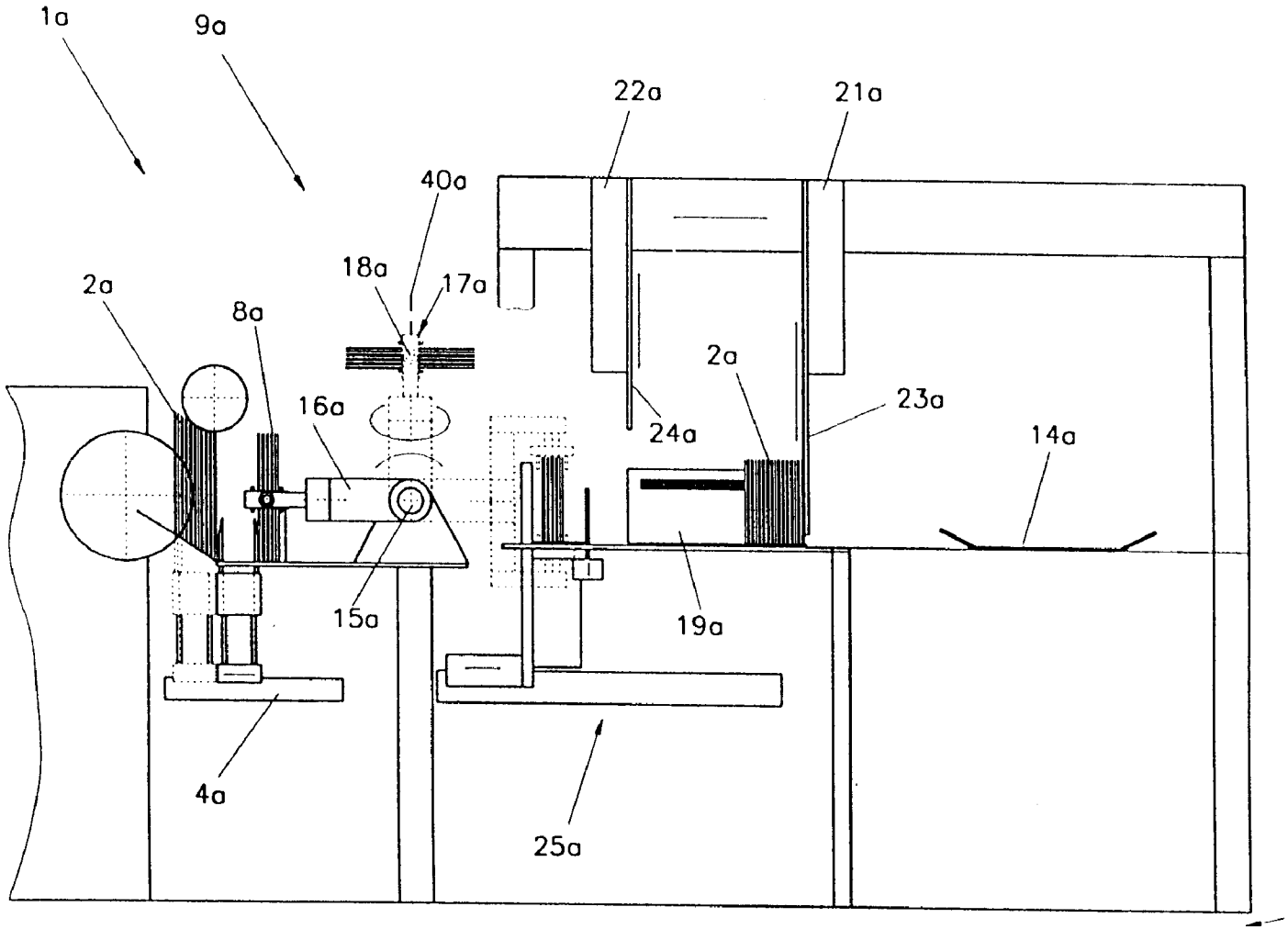
FIG. 3 shows a view as in FIG. 1 of a modified embodiment.
Figure 4:
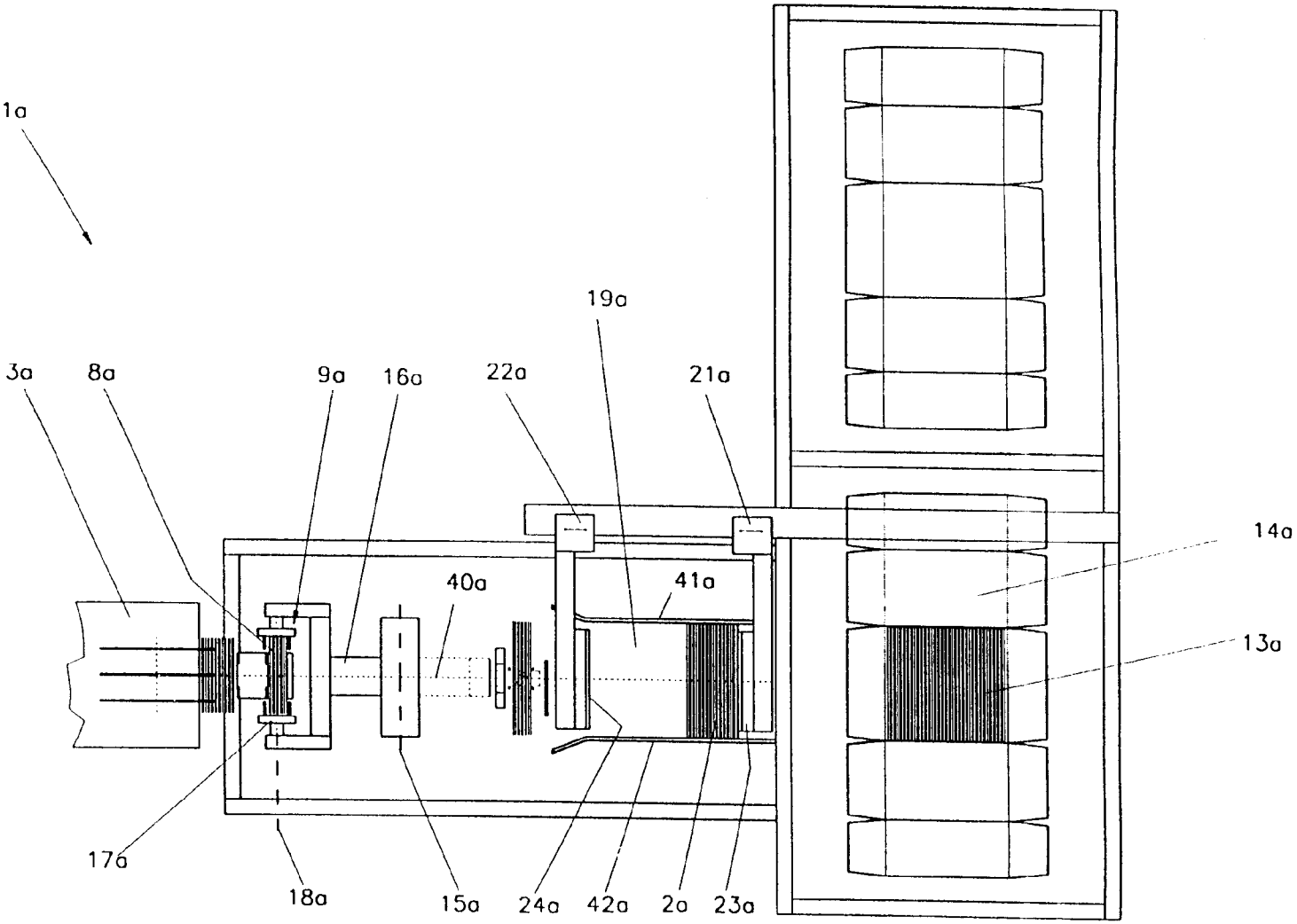
FIG. 4 is a plan view of the device in accordance with FIG. 3 on a smaller scale.

The device 1*a* shown in FIGS. 3 and 4 shows a modified embodiment, whereby like parts being in principle denoted by the same reference numerals with the addition of a letter "a".

While most parts of the device la are constructed exactly as the parts of the first described embodiment, the turning device 9*a* has an additionally provided axis 40*a* in the form of a pivot and/or rotational axis for the gripper 17*a*. The gripper 17*a* is accordingly tiltable about a gripper axis 18*a* and about an axis 40*a* perpendicular thereto. The gripper axis 18*a* in turn extends in parallel to the axis 15*a* of the carrier 16*a*. In addition or as an alternative the gripper 17*a* is also tiltable about the second gripper axis 40*a*.

The carrier 16*a* may, as more particularly illustrated in FIG. 4, be an arm extending perpendicularly to the axis 15*a*, or a pivotal arm, whose longitudinal axis coincides with the gripper axis 40*a*.

For the control of the gripper 17*a* and to produce rotary or, pivotal movements there is, just like for the gripper 17, a separate drive, which in the case of the gripper 17*a* makes it possible to deposit received partial stacks 8*a* or stationery envelopes 2*a*, on any desired edge in the transfer device 25*a*. The function of the turning device 9*a* is consequently not limited to deposit on two edges, and in fact allows selective deposit on all four edges of a stationery envelope.

Furthermore, the additional axis 40*a* increases the possibility to process differently formed stationery envelopes 2*a*. If necessary, the side walls 41*a* and 42*a* of the channel-shaped stacking path 19*a* must be adjustable. In the same way the gripper 17*a* may be adjustable to different formats.

A further example embodiment of a modified turning device 9*b* is illustrated in FIGS. 5 to 9 and comprises a machine frame 50*b*, in which a lifting frame 51*b* is arranged at least for the carrier 16*b* and its gripper 17*b* in an elevation adjustable fashion. In this example embodiment corresponding parts also bear the same reference numeral as in the first described cases, with the addition of the letter b.

The lifting frame 51*b* is mounted on the machine frame 50*b* with the aid of a plurality of holding and guiding elements 52*b*. For an elevation adjustment there is a drive 53*b* and a threaded spindle 54*b*, which adjust the lifting frame 51*b* through a spindle nut in a manner not illustrated in detail.

On the guided side parts 55*b* and 56*b* of the lifting frame 51*b*, the carrier 16*b* for its gripper 17*b* is mounted for pivotal and/or rotary movement about an axis 15*b*.

On a transverse beam 57*b* in the bottom region of the lifting frame 51*b* the drive 58*b* and its control and power transmission components are arranged for the shaft or axis 15*b*. According to this example embodiment the transmission of power from the drive 58*b* to the carrier 16*b* is accomplished with the aid of a belt 59*b*.

Figure 7:
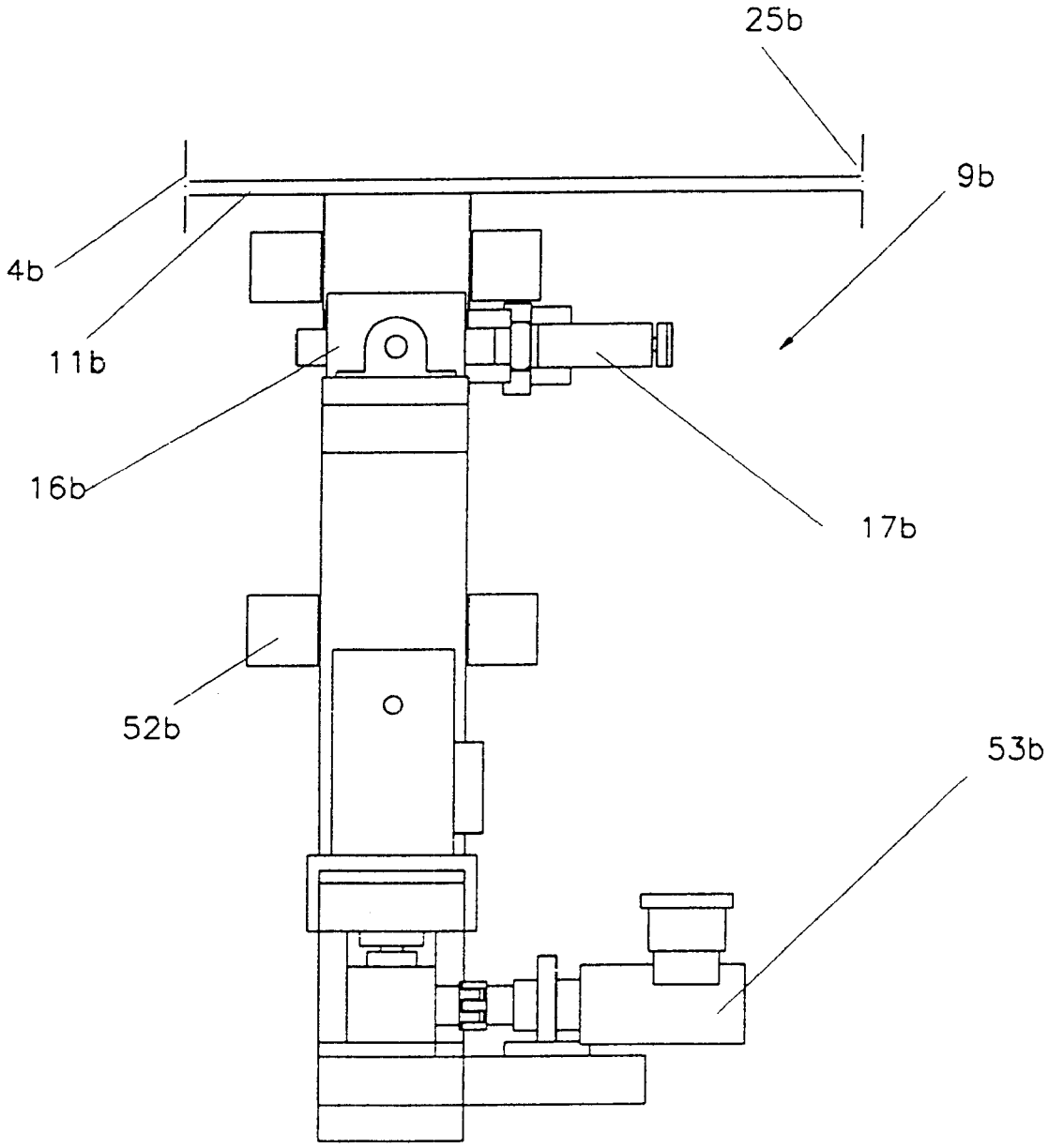
FIG. 7 is a side view of the turning device in accordance with FIGS. 5 and 6 with the gripper and its drive in a position lowered to a level below a stacking plane.
Figure 8:
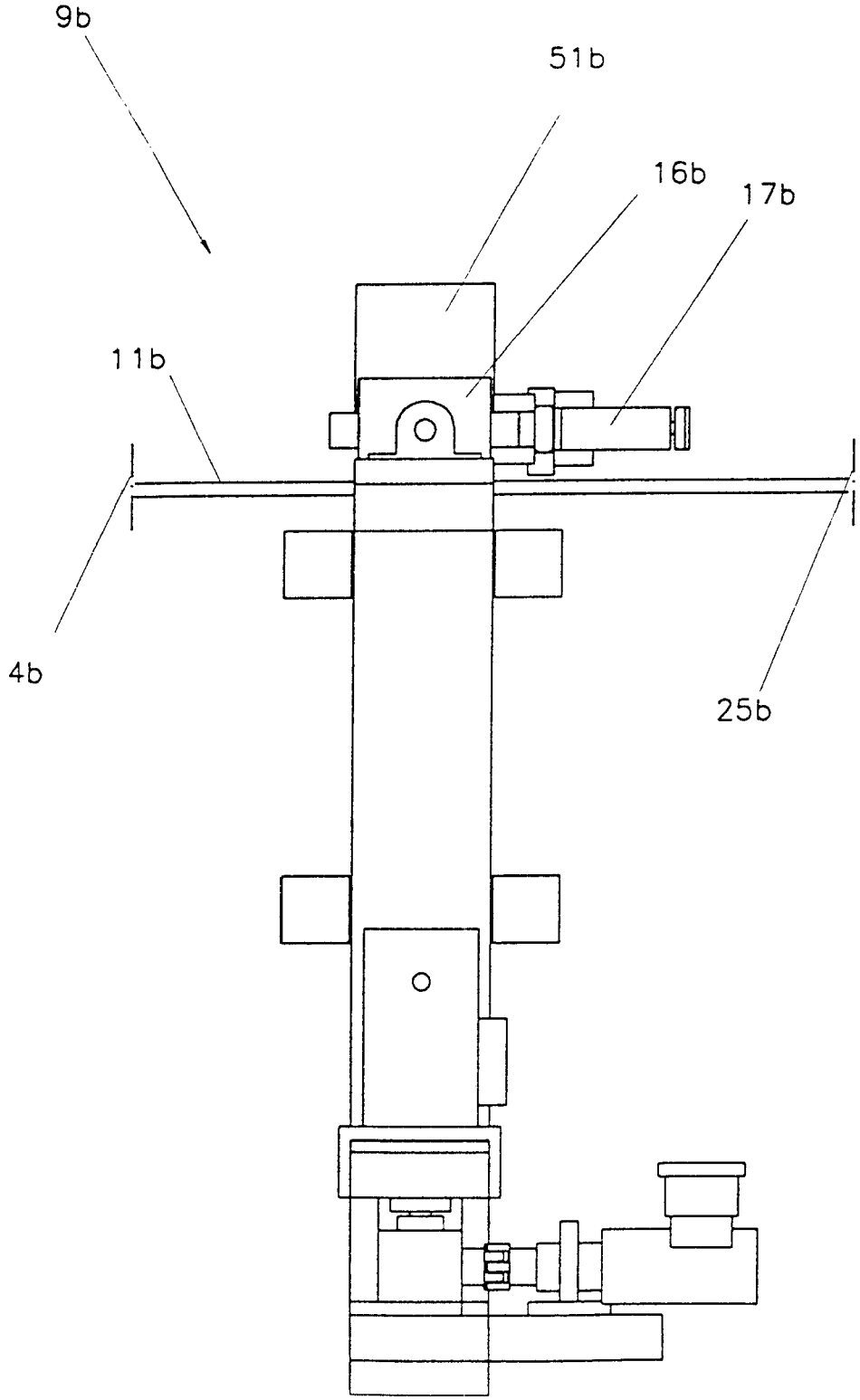
FIG. 8 is a view similar to that of FIG. 7 with the gripper and its drive in a position raised above the stacking plane.
Figure 9:
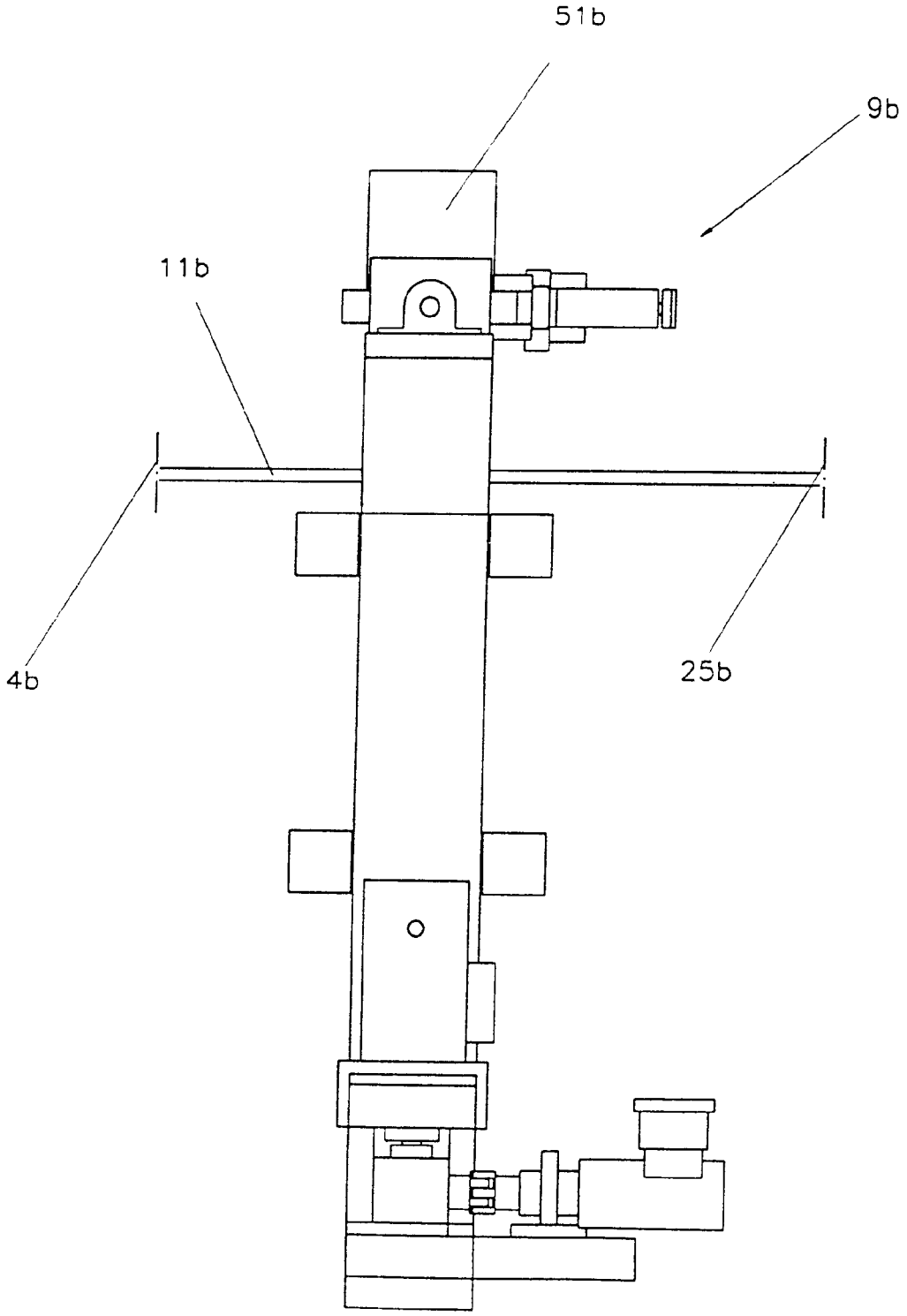
FIG. 9 is a view as in FIG. 8 with a gripper raised still higher.

The sense and purpose of the vertically adjustable lifting frame 51*b* mounted and guided in the machine frame 50*b*, is to be able to lower the carrier 16*b* together with its gripper 17*b* as shown in FIG. 7 till it is underneath a stacking plane 11*b*, defined for instance by a stacking sheet metal, or to position it at different levels above the stacking plane 11*b*, as is shown in FIGS. 8 and 9.

According to FIG. 7 the turning device 9*b* is shown lowered below the level of the stacking plane 11*b* so that instead of an automatic operation a purely manual one is possible.

The arrangement of the carrier 16*b* and of its gripper 17*b* at different elevations above the stacking plane 11*b* as illustrated in FIGS. 8 and 9, enables the carrier 16*b* and its gripper 17*b* to accept-partial stacks placed in the area of the transfer station 4*b* with quite different formats and after rearranging may deposit same in the area of the take-up device 25*b*.

According to the example embodiment of the invention illustrated in FIGS. 5 to 9 the gripper 17*b* is preferably tilted back and forth between the transfer station 4*b* and the take-up device 25*b*. Thereby the stationery envelopes are lifted and then put down again or rearranged and set on the same or a different edge. In order to return to its starting position the gripper 17*b* may, however, also-describe a complete circular motion of 360°. For this purpose the lifting frame 51*b* must be U-shaped at least in the area of the gripper 17*b*. In order to obtain a sufficient rigidity it is possible for it to be closed at the top in a U-shaped fashion, (not shown in FIG. 5).

It will be further understood that for a complete rotary movement of the gripper 17*b* about the axis 15*b*, the belt 59*b* must be outside of the path of movement of the gripper 17*b*.

Figure 5:
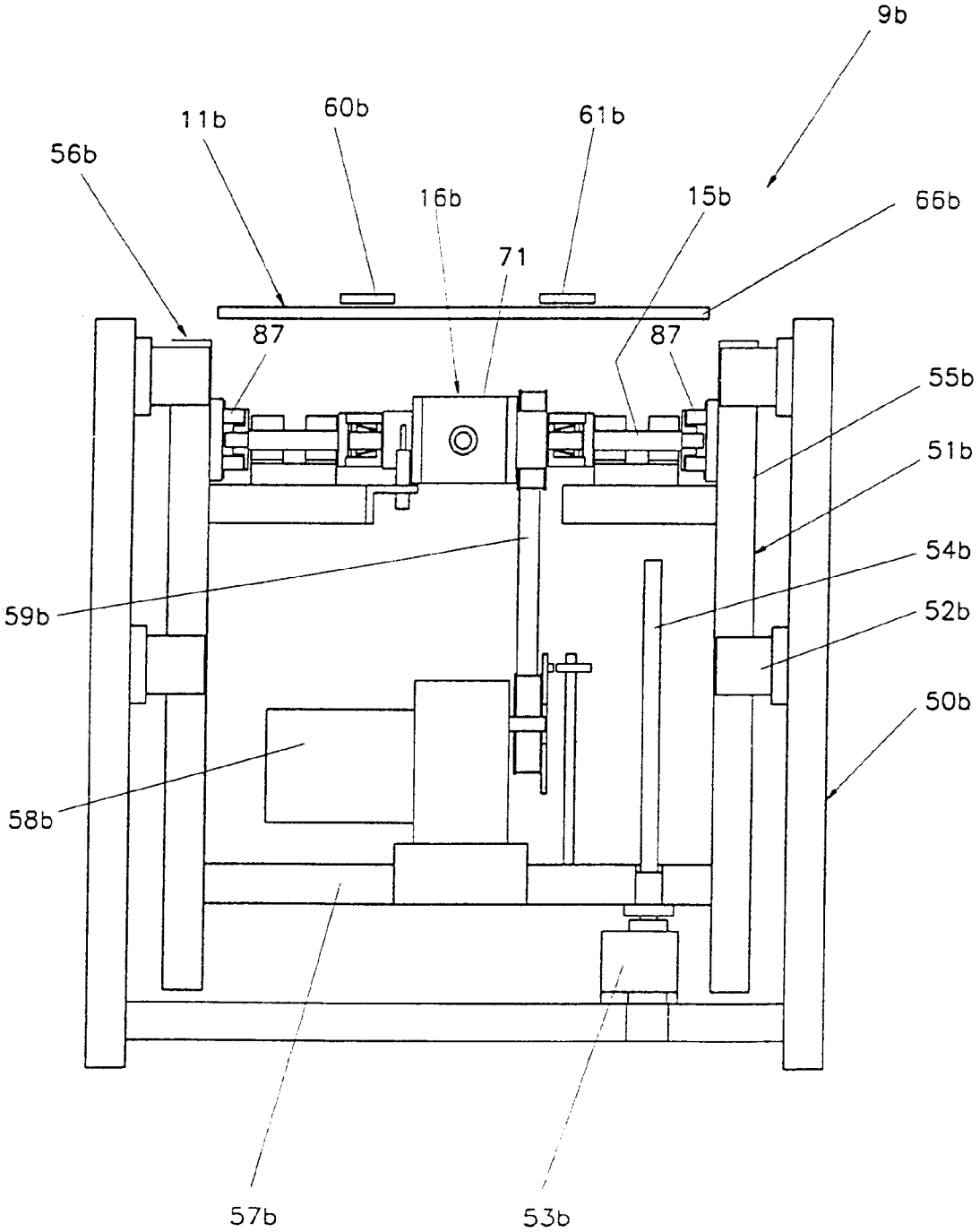
FIG. 5 is a lateral facing view of a turning device of a further example embodiment.

FIG. 5 shows conveyor belts 60*b* and 61*b* serving as carrier elements, which however are used only when the turning device 9*b* is lowered and during manual operation. They are provided as an option and usable when needed and they constitute the stack plane 11*b*, to which an auxiliary table 66*b* also belongs.

Figure 6:
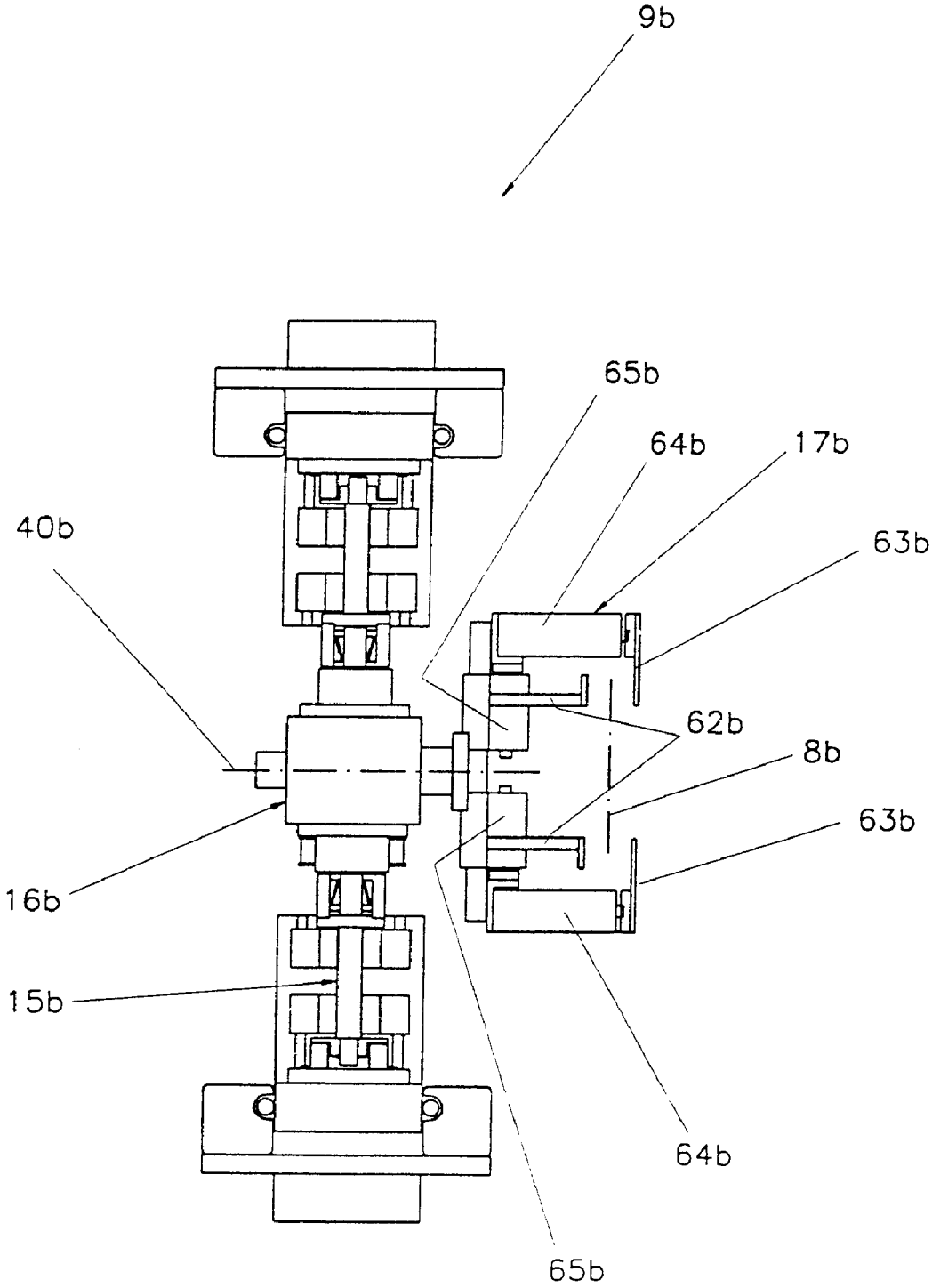
FIG. 6 is a plan view of the turning device in accordance with FIG. 5.

It will be also seen from FIG. 6 that the gripper 17*b* in accordance with example embodiment possesses two fixed abutments 62*b* and two adjustable abutments 63*b*, which together with the fixed abutments 62*b* serve as holding elements. The partial stacks 8*b* are held between the fixed abutments 62*b* and the adjustable abutments 63*b*, as is indicated in dashed lines in FIG. 6.

For readjusting the adjustable abutments 63*b* in a direction toward the fixed abutments 62*b* and away from them, a respective drive 64*b* may be utilized, which may for example be a pneumatic drive. Further drives 65*b* are respectively provided in order to additionally move the adjustable abutments 63*b* away from each other and toward each other. They move the abutments 63*b* apart, when the gripper 17*b* is pivoted on its way back in the transfer zone behind the compartmented disk over the partial stack 8. In the rear dead center point of the gripper 17*b* the abutments 63*b* are moved together by their drives 65*b* and then hold the partial stack 8 with the aid of their drives 64*b* and the abutments 62*b*.

The embodiment depicted in FIG. 6 is furthermore significant in that the gripper 17*b*, more concretely a gripping device, may be pivoted or moved with the aid of the carrier 16*b* about a single axis or gripper axis 40*b*, such axis extending perpendicularly to the axis 15*b* about which the carrier 16*b* in the turning device 9*b* is tiltable or respectively movable.

Figure 10:
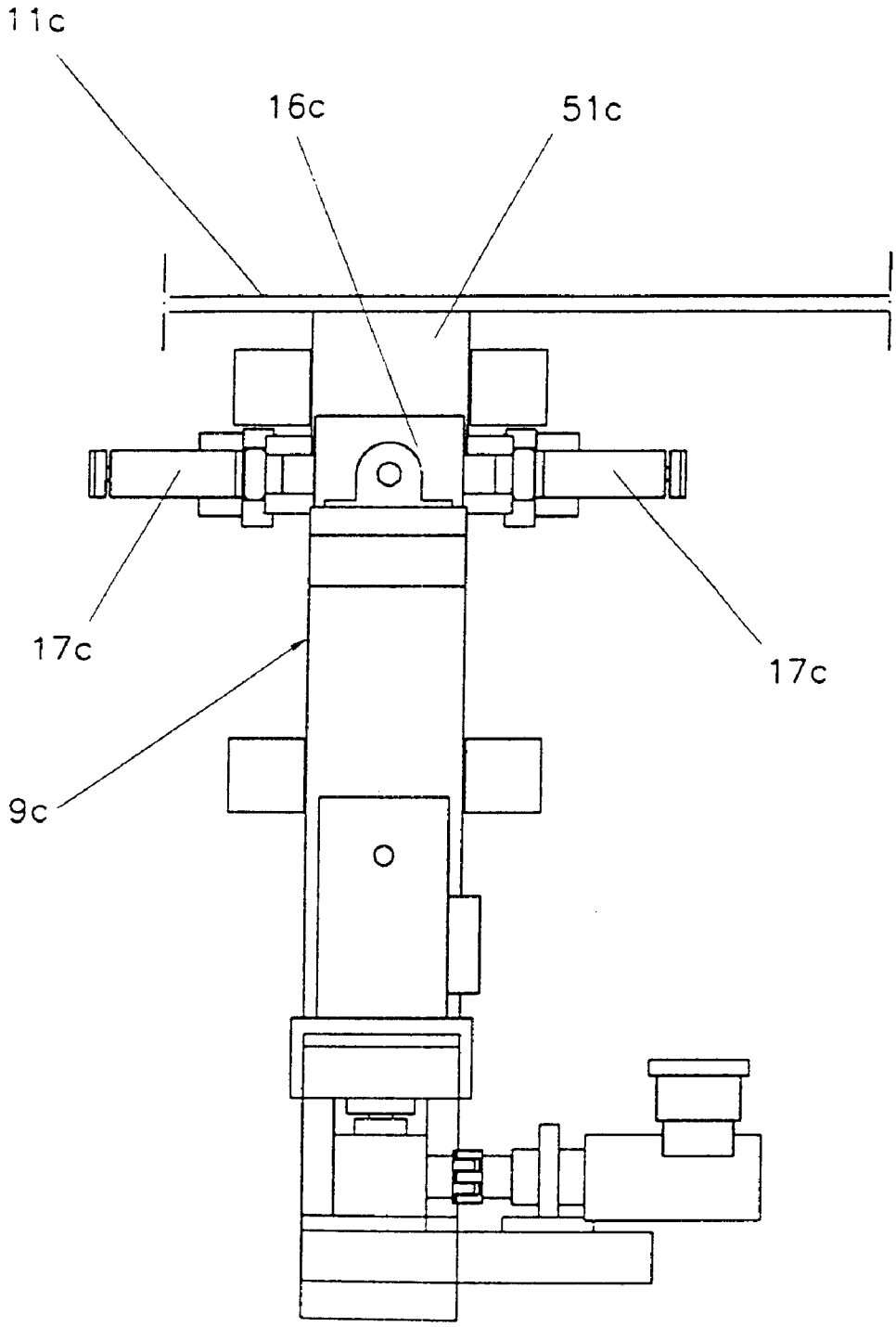
FIG. 10 is a lateral view as in FIG. 7 of a further example embodiment having two grippers.
Figure 11:
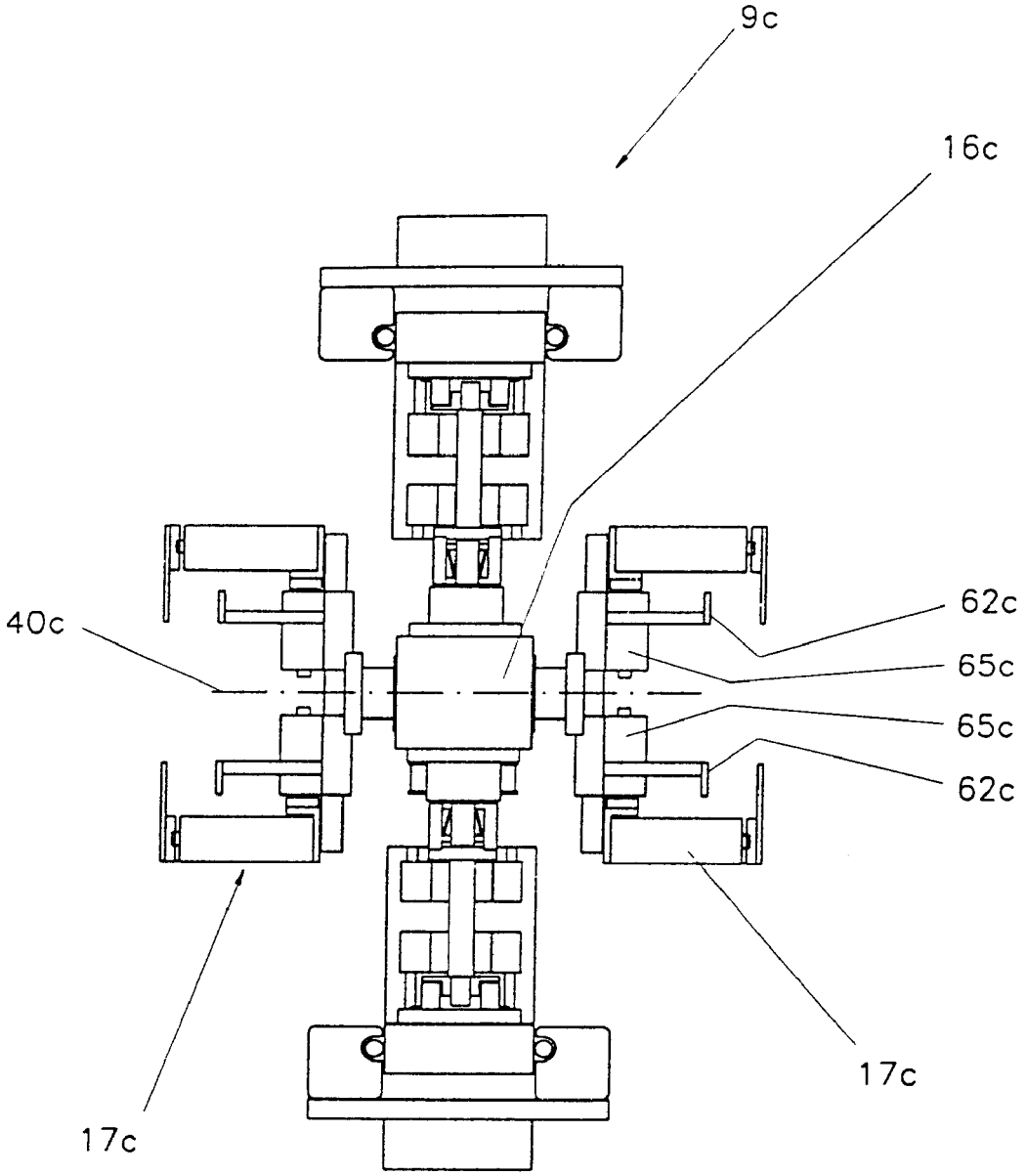
FIG. 11 shows a plan view of the turning device according to FIG. 10.

In accordance with a further embodiment of the invention, which is shown in FIGS. 10 and 11, it is possible for two grippers 17*c* to be respectively mounted on one carrier 16*c*. Here as well respective identical parts bear the same reference numerals, as previously, with the addition of the letter index c.

The grippers 17*c* are positioned, relative to their circular movement, respectively diagonally opposite each other.

FIG. 10 shows the turning device 9 with grippers 17*c* positioned below the stacking plane 11 so that manual operation is readily possible. It will however be understood that the grippers 17*c* with their carrier 16*c*, just as in the last-described example embodiment, are movably mounted in a lifting frame 51*c* so that they may be moved to the desired elevation above the stacking plane 11*c*.

Figure 12:
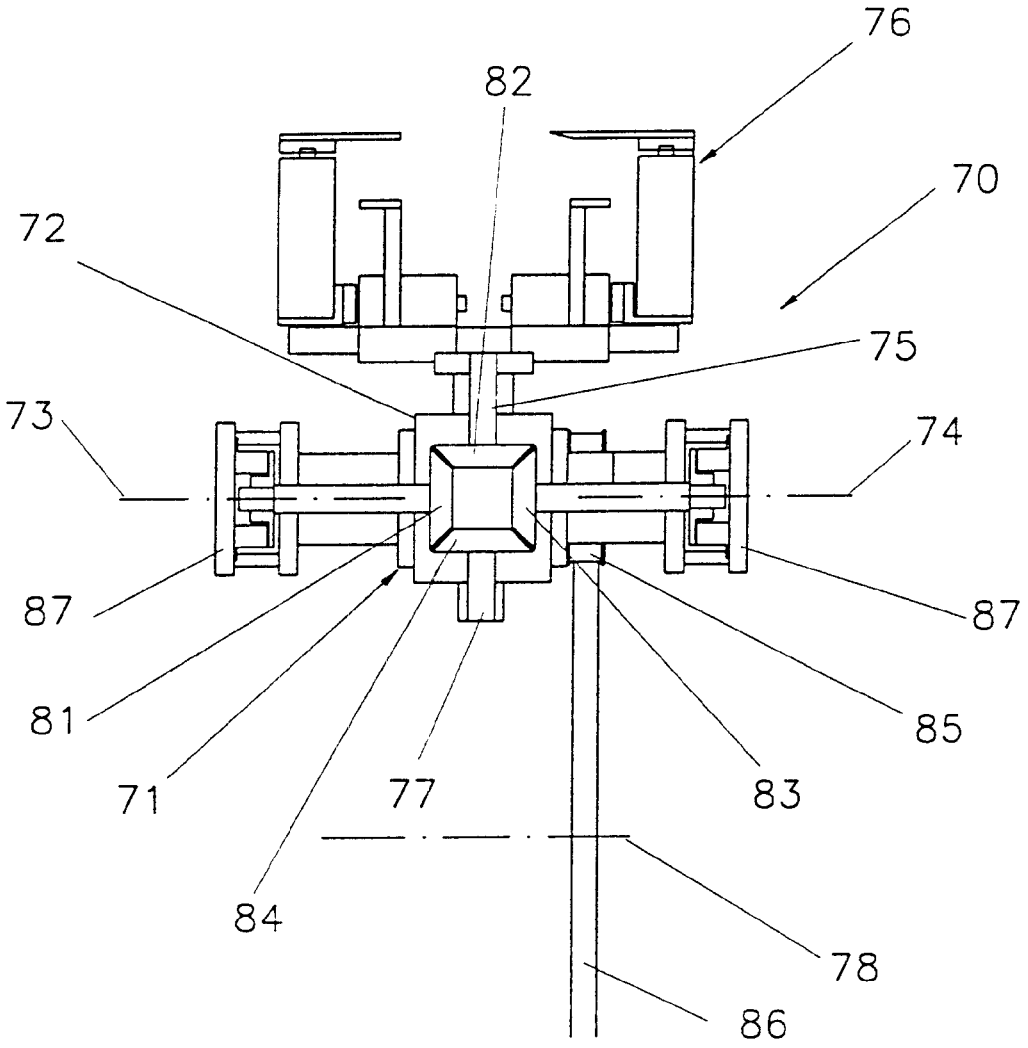
FIG. 12 is a principle sketch of a gripper and its drive.

Finally, as indicated in FIG. 12 a carrier 70 will suitably comprise a differential transmission 71. Basically the same applies to the example embodiments of the invention depicted in FIGS. 5 to 11.

The differential transmission 71 comprises a housing 72, in which axes or, respectively, shafts 73 and 74 corresponding to the pivot and/or rotational axes of the carrier of the first described example embodiment and at least one gripper axis 75 for a gripper 76 shown in full lines, or also a second gripper axis 77 for a second gripper 78 shown in dashed lines, are mounted.

As shown in FIG. 12, each axis or shaft 73, 74, 75 and 77 carries a bevel gear wheel 81, 83, 82 and 84, respectively.

A drive element 85 is rigidly secured to the housing 72 of the differential transmission 71. Such drive element 85 is a belt pulley according to the example embodiment and in conformity with the belt drive of the turning device 9*b* (FIG. 5). Via a belt 86 the housing 72 and the grippers 76 or 78 are moved for rearranging partial stacks whereby the inherent motion (pivotal and/or rotational motion) of the grippers 76 and 78 are controlled by an electromagnetic coupling 87. In the case of two or more grippers 76 and 78 or in the case of a rotary movement of the grippers 76 and 78 about the axis 73 and 74, the belt 86 must be outside the path of the motion of the grippers 76 and 78.

It will finally be understood that a particularly advantageous and economic construction is produced if one gripper 76 rearranges and turns the partial stacks, while the other gripper 78 only rearranges the partial stacks and does not perform any inherent movement. Inherent motion of partial stacks may in this case basically take place about an axis, positioned in a plane of a letter envelope or article, and/or about an axis intersecting this plane perpendicularly, while the partial stack is being rearranged along a portion of a curve.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for handling flat articles, each flat article having a first edge (a) and a second edge (b) extending in parallel to said first edge (a), said method comprising the following steps:

a) feeding said flat articles as an on-edge row of said flat articles from an article production to a separation location for forming partial stacks (8);

b) sequentially gripping said partial stacks (8) of said on-edge row of articles;

c) first rotating each partial stack (8) about a first rotation axis (15) extending in parallel to said first and second edges (a, b) of said flat articles;

d) second rotating every other partial stack (8) about a second rotation axis (40*a*) extending at a right angle to said first rotation axis (15) so that upon completion of said first and second rotating said first and second edges (a, b) of said flat articles are located in alternating opposite positions in neighboring partial stacks of said partial stacks to form a completed stack (13); and (e) performing said second rotating of every other partial stack during said first rotating of every other partial stack.

2. The method of claim 1, further comprising performing said first rotating of each partial stack (8) about said first rotation axis (15) so that each partial stack is moved through 180°.

3. The method of claim 1, further comprising performing said second rotating of every other partial stack about said second rotation axis (40*a*) so that every other partial stack is moved through 180°.

4. A method for handling flat articles, each flat article having a first edge (a) and a second edge (b) extending in parallel to said first edge (a), said method comprising the following steps:

a) feeding said flat articles as an on-edge row of said flat articles from an article production to a separation location for forming partial stacks (8);

b) sequentially gripping said partial stacks (8) of said on-edge row of articles;

c) first rotating each partial stack (8) about a first rotation axis (15) extending in parallel to said first and second edges (a, b) of said flat articles;

d) second rotating every other partial stack about a second rotation axis (18) extending in parallel to said first rotation axis (15) so that upon completion of said first and second rotating said first and second edges (a, b) of said flat articles are located in alternating opposite positions in neighboring partial stacks of said partial stacks for forming a completed stack (13); and e) performing said second rotating of every other partial stack during said first rotating of every other partial stack.

5. The method of claim 4, further comprising performing said first rotating of each partial stack (8) about said first rotation axis (15) so that each partial stack is moved through 180°.

6. The method of claim 4, further comprising performing said first rotating in one rotation direction and performing said second rotating in an opposite rotation direction.

7. An apparatus for handling flat articles, each flat article having a first edge (a) and a second edge (b) extending in parallel to said first edge (a), said apparatus comprising:

(a) an article supporting stacking surface (11) for receiving an on-edge row of said flat articles, (b) at least one gripper (17*a*) for sequentially gripping partial stacks (8) out of said on-edge row of said flat articles, (c) at least one gripper carrier (9, 16) including a support and a first rotation axis (15) for rotatably securing said at least one gripper carrier to said support for rotating said at least one gripper carrier about said first rotation axis (15), said first rotation axis (15) of said at least one gripper carrier extending in parallel to said first and second edges (a, b) of said flat articles, and (d) a second rotation axis (40*a*) operatively securing said at least one gripper (17*a*) to said at least one gripper carrier, said second rotation axis (40*a*) extending at a right angle to said first rotation axis (15), and (e) means operatively connected for rotating said at least one gripper carrier about said first rotation axis and said at least one gripper about said second rotation axis (40*a*).

8. The apparatus of claim 7, wherein said at least one gripper carrier is rotatable about said first rotation axis (15) through an angular range of 360° in a clockwise and counterclockwise direction.

9. The apparatus of claim 7, wherein said at least one gripper (17*a*) comprises first and second abutments (62*b*, 63*b*) movable relative to each other.

10. The apparatus of claim 7, wherein said at least one gripper comprises two stationary abutments (62*b*) and two movable abutments (63*b*), and drive means operatively connected to said movable abutments (63*b*) for moving said movable abutments relative to said stationary abutments and relative to each other.

11. The apparatus of claim 7, further comprising a collecting station (12) positioned downstream of said at least one gripper carrier, as viewed in a movement direction from said receiving station to said collecting station for collecting said partial stacks from said at least one gripper and for forming a complete stack (13) of said partial stacks, and a packaging station (6) arranged downstream of said collecting station (12).

12. The apparatus of claim 11, wherein said collecting station (12) comprises side walls (41*a*, 42*a*) and a bottom forming a channel-shaped stacking path (19, 19*a*).

13. The apparatus of claim 11, wherein said side walls (41*a*, 42*a*) of said channel-shaped stacking path (19, 19*a*) are adapted for adjusting a spacing between said side walls.

14. The apparatus of claim 11, further comprising a stack clamping and holding mechanism (20) arranged for moving said complete stack (13) out of said collecting station (12) into said packaging station (6).

15. The apparatus of claim 11, further comprising a partial stack transfer station (25) positioned between said at least one gripper carrier and said collecting sation, said partial stack transfer station comprising a partial stack holding slide (26) for moving partial stacks into said collecting station.

16. The apparatus of claim 7, wherein said at least one gripper carrier comprises a differential gear transmission (71) and an electromagnetic coupling cooperating with said differential gear transmission.

17. The apparatus of claim 7, wherein said support of said at least one gripper carrier carrying said at least one gripper comprises means for vertically adjusting an elevational position of said at least one gripper carrier and of said at least one gripper rotatably secured to said at least one gripper carrier.

18. The apparatus of claim 7, comprising at least two grippers (76, 78) operatively secured to said at least one gripper carrier.

19. The apparatus of claim 18, wherein said at least two grippers are arranged diametrically opposite each other on said at least one gripper carrier (70).

20. The apparatus of claim 7, further comprising a third rotation axis (18*a*) securing said at least one gripper (17*a*) to said second rotation axis (40*a*) so that said third rotation axis (18*a*) extends at a right angle to said second rotation axis and in parallel to said first rotation axis (15*a*) of said at least one gripper carrier (16*a*).

21. An apparatus for handling flat articles, each flat article having a first edge (a) and a second edge (b) extending in parallel to said first edge (a), said apparatus comprising:

(a) an article supporting stacking surface (11) for receiving an on-edge row of said flat articles, (b) at least one gripper (17*a*) for sequentially gripping partial stacks (8) out of said on-edge row of said flat articles, (c) at least one gripper carrier (9, 16) including a support and a first rotation axis (15) for rotatably securing said at least one gripper carrier to said support for rotating said at least one gripper carrier about said first rotation axis (15), said first rotation axis (15) of said at least one gripper carrier extending in parallel to said first and second edges (a, b) of said flat articles, and (d) a second rotation axis (18) operatively securing said at least one gripper (17*a*) to said at least one gripper carrier, said second rotation axis (18) extending in parallel to said first rotation axis (15), and (e) means operatively connected for rotating said at least one gripper carrier about said first rotation axis (15) and said at least one gripper about said second rotation axis (18).

22. The apparatus of claim 21, wherein said at least one gripper carrier is rotatable about said first rotation axis (15) through an angular range of 360° in a clockwise and counterclockwise direction.

* * * * *